United States Patent [19]

Kirkham

[11] 3,937,618

[45] Feb. 10, 1976

[54] METHOD FOR PRODUCING BI-METAL OBJECT AND PRODUCT THEREOF

[75] Inventor: Kathleen E. Kirkham, Drexel Hill, Pa.

[73] Assignee: Franklin Mint Corporation, Franklin Center, Pa.

[22] Filed: July 9, 1973

[21] Appl. No.: 377,378

[52] U.S. Cl. ..... 29/182.2; 75/208 R
[51] Int. Cl.[2] ..... B22F 1/00; B22F 7/00
[58] Field of Search ..... 75/208 R; 29/182.2

[56] References Cited

UNITED STATES PATENTS

| | | | |
|---|---|---|---|
| 3,360,348 | 12/1967 | Schreiner | 75/208 |
| 3,367,752 | 2/1968 | Johnson | 75/208 |
| 3,373,003 | 3/1968 | Schreiner | 75/208 |
| 3,499,739 | 3/1970 | Segel | 29/194 |

OTHER PUBLICATIONS

Knopp et al. et al., *International Journal of Powder Metallurgy*, Vol. 3, No. 1, pp. 57–62, (1967).

*Primary Examiner*—Benjamin R. Padgett
*Assistant Examiner*—B. Hunt
*Attorney, Agent, or Firm*—Seidel, Gonda & Goldhammer

[57] ABSTRACT

A method is provided for producing a bi-metal object comprised of at least one image area raised in relief on the base of the object. The area in relief and the base of the object consist of different metals. The method comprises compacting the metal powder which will constitute the image area raised in relief; compacting the metal powder which will constitute the base of the bi-metal object while that powder is in direct contact with the metal powder already compacted to form the area in relief; sintering the composite at a relatively low temperature and for a preferred interval of time; and striking a chosen design on the base of the bi-metal object. The finished product will comprise an image area raised in relief which will be of appreciable height; the image area raised in relief will be separated from the base by a sharp regular border; and the base may retain a proof finish.

17 Claims, 13 Drawing Figures

METHOD FOR PRODUCING BI-METAL OBJECT AND PRODUCT THEREOF

BACKGROUND OF THE INVENTION

This invention relates to a method for producing bi-metal objects, for example, tokens, medallions or commemorative coins.

Methods for producing bi-metallic objects are well-known in the art. For example, plating one metal surface with another by electrolysis or dipping is generally known; and the use of powder metallurgy, that is, subjecting a metal powder to pressure and heat treatment, may be used to form a bi-metal object as described in U.S. Pat. No. 3,499,739.

However, the prior art poses significant problems. First, the area in relief or the image area may not protrude appreciably above the abutting base surface of the object. For example, in producing a bi-metal object by the process of electroplating, it may not be possible to obtain an image area which protrudes more than approximately 125 micro inches above the abutting base surface of the object. And where a higher relief is formed by the process of repeated striking and annealing, the base finish will be unevenly reflective.

Second, a precise regular boundary separating a high relief image area metal from the different metal of the abutting base surface cannot be achieved using methods presently available in the art for producing bi-metal objects.

Third, where sintering is employed in the process for producing the bi-metal object, shrinkage or growth of the dimensions of the object may occur to a degree impractical to predict. Consequently, the dimensions of the final striking die will be difficult to determine with sufficient accuracy to retain the highly desirable sharp border between the two metals.

The present invention provides a method for producing a bi-metal object comprising an area in relief raised significantly higher than 125 micro inches above the base of the object. Moreover, the base of the object will be evenly reflective or will retain a proof finish.

In accordance with the method of the present invention a novel bi-metal object with a highly precise border separating the two constituent metals will be obtained. In addition, the objects will be of uniform dimensions.

Accordingly, it is a general object of the present invention to provide a new and unobvious bi-metallic object as well as a new and unobvious method for producing that object.

More particularly, it is an object of the present invention to provide a new and unobvious bi-metallic object comprising an image area raised appreciably above the abutting base surface of the object.

Moreover, it is an object of the present invention to provide a new and unobvious bi-metallic object comprising an image area separated from the abutting base surface of the object by a sharp and regular boundary.

Another object of the present invention is to provide a bi-metallic object whose base surface abutting the image area will retain a proof finish.

Yet another object of the present invention is to provide a new and unobvious method for producing the bi-metal object of the properties described above.

Other objects will appear hereinafter.

BRIEF SUMMARY OF THE INVENTION

The present invention offers a unique solution to the problems confronting the prior art in producing bi-metal objects. A metal powder is compacted to form the desired image area to be raised in relief on the base; a second metal powder is brought into physical contact with the compacted image; while in physical contact with the compacted image, the second metal powder is compacted thereby forming a composite; the composite is then sintered at a designated temperature and for a preferred interval of time to produce a durable bi-metal object without any significant dimensional change; and the base of the composite is then struck in the conventional manner for embossing a metal object.

In a preferred embodiment, the bi-metal object may be a coin or medal and the image area may be comprised of gold and the base may be comprised of silver. However, other metals may be used for the image and base areas. For example, nickel, copper, bronze or tin may be preferred.

Significantly, where the preferred metals are gold and silver, the sintering will take place at a temperature as low as 400° F. and for an interval of about 2 hours in any clean atmosphere; the product will be a durable object without objectional dimensional change due to grain growth or shrinkage.

The bi-metal object formed by this unique method will comprise an image area raised in relief approximately 0.100 inches or more above the abutting base surface.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
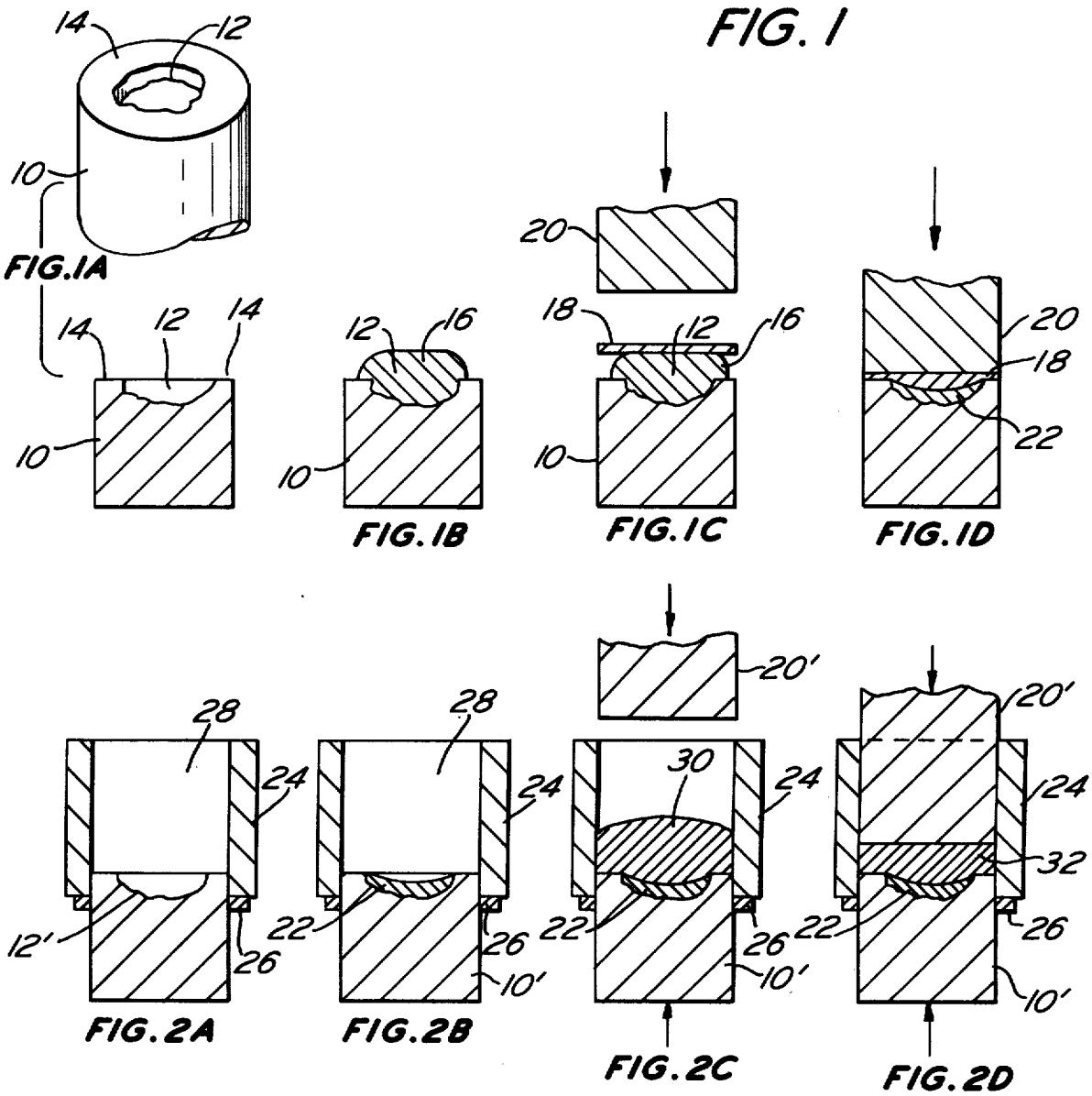
FIG. 1 illustrates the first four steps of the method of the present invention.

Referring to the drawing in detail wherein like numerals indicate like elements, there is shown in FIG. 1A a first die designated generally as 10. The first die 10 comprises a first die cavity 12 which has been formed according to the desired image area. Specifically, the first die cavity 12 consists of the negative of the desired relief or image. First die lands 14 surround the first die cavity 12 and are located within the plane from which die cavity 12 is recessed.

The dies used in the present invention may be made of any suitable conventional materials, such as steel alloy. The die cavities may be formed by conventional engraving techniques or etching. These cavities may also be treated to produce desired finishes, such as by sand or diamond blasting to produce a frosted finish or polishing to produce a shiny finish, as are known in the art.

According to the method of the present invention, the second step is illustrated in FIG. 1B. There, first die cavity 12 is filled with first metal powder 16. The cavity 12 is slightly overfilled with powder 16 in order to ensure proper compaction in the later steps of the process. However, if desired, the cavity may be filled to its precise capacity without overfilling or the cavity may in fact be underfilled. Rather than assume the risk of underfilling the cavity, with corresponding detriment to the compacting step, die cavity 12 is slightly overfilled. In general, the degree of filling or overfilling will depend on the final desired thickness of metal in the image area to be raised in relief.

In FIG. 1C a powder press 20 is shown descending upon resilient cover 18 which rests in physical contact upon first metal powder 16.

Focusing now on FIG. 1D, powder press 20 is shown in physical contact with resilient cover 18. As depicted, die 10 is stationary. However, a dual action press may be employed if desired. Desired compaction of first metal powder 16 will be achieved at relatively low pressure. Thus, press 20 will be a low tonnage press of force roughly one ton or less.

In this manner, metal powder 16 is compacted within cavity 12 to form relief compact 22. Preferably, resilient cover 18 is employed to ensure more perfect compacting; alternatively, as will be apparent to one of ordinary skill in the art, powder press 20 may be brought into immediate contact with lands 14 and metal powder 16 (without the interposition of a cover) to form relief compact 22.

Typically, powder 16 may be of size from 0.50 to 15 microns. However, other size powders may also be used.

Where resilient cover 18 is employed a slight concavity in relief compact 22 will result. This is due to the resiliency of cover 18 and the unequal distribution of pressure across lands 14 and the outer surface of powder 16 upon initial contact of powder press 20 with cover 18. The concavity will be slight since press 20 will be a low tonnage press impinging with a force of approximately one ton or less. Consequently, the slight concavity will have negligible effect on the properties of relief compact 22. Resilient cover 18 may be of any suitable relatively resilient or plastic material, such as polyethylene, rubber. The degree of resiliency is not critical, but the material should not be so rigid or brittle that it will crack under the force of the press. The thickness is also not critical and may suitably be about ¼ inch.

Upon completion of the compacting step in first die 10, relief compact 22 is sufficiently cohesive to permit removal from die cavity 12 by simple tapping of die 10. It will not be necessary to lubricate die cavity 12 in order to remove relief compact 22. It is of consequence that such lubrication is also unacceptable since a lubricant would mar the surface of relief compact 22, precluding a proof finish.

Any excess metal which may form about the periphery of cavity 12, where the cavity 12 and lands 14 meet, may be easily removed by scraping or air blasting or other similar technique known in the art.

Figure 2:
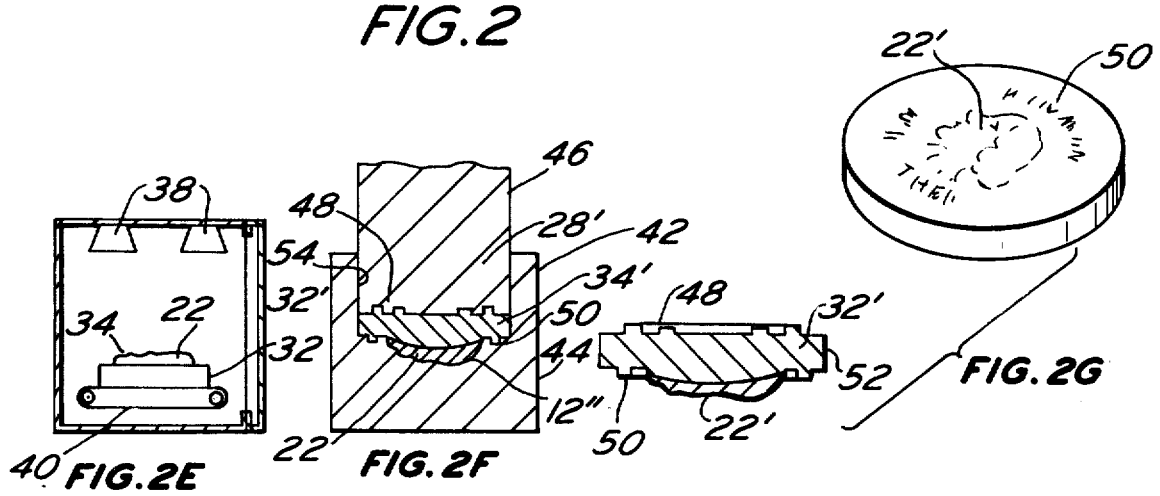
FIG. 2 illustrates the final four steps of the method of the present invention as well as the final bi-metal object of the present invention.

Directing attention to FIG. 2, that is, the final four steps of the invention, FIG. 2A shows a second die 10' comprising a second die cavity 12'. Retaining ring 26, fastened to die 10', supports collar 24. Alternatively, collar 24 may be supported by means of a conventional die set. Collar 24 embraces the outer surface of die 10' thereby enclosing second die cavity 12'. Where second die 10' and collar 24 may be cylindrical, collar 24 will define an inner phantom cylindrical area 28.

Second die cavity 12' is formed identically to first die cavity 12. Thus, relief compact 22 may be inserted exactly into die cavity 12' as illustrated in FIG. 2B. If desired, relief compact 22 may simply be left in first die cavity 12 of first die 10, and first die 10 would then simply be fitted with collar 24 and retaining ring 26 in order to carry out the second compacting step. However, in production it will be best to have separate dies 10 and 10' with identical die cavities 12 and 12' respectively.

With die 10', ring 26 and collar 24 assembled, inner phantom area 28 will be filled to the desired level with second metal powder 30 as depicted in FIG. 2C. Referring to FIG. 2C, second powder press die 20' is lowered into phantom area 28. Die 20' is of a diameter slightly less than the diameter of phantom cylinder 28 in order to permit insertion.

FIG. 2D shows the actual step of compacting. There, die 20' has been brought into contact with second metal powder 30 to form base compact 32. As indicated in FIGS. 2C and 2D, a dual action press is preferably employed so that second die 10' and die 20' are propelled toward each other. The second compacting step takes place at from 100 to 300 tons force in order to obtain the desired proof finish without inducing striations in the base compact 32.

Relief compact 22 and base compact 32 form composite 34. Composite 34 is easily removed from collar 24 and cavity 12' by ejection with die 10' as is common in the art. Lubrication of cavity 12' is not necessary. Thus the problem of contamination of the relief and base surfaces is avoided. However, if desired, collar 24 may be lubricated to facilitate extraction of composite 24 without endangering the desired proof finish, and in order to prevent scoring of the edges.

Following the second compaction, composite 34 is sintered in sintering chamber 36 as shown in FIG. 2E. Composite 34 is supported by tray or support 40 and heated by heat source 38. Sintering of gold and silver will take place at roughly 400° F. and for approximately 2 hours.

This is a relatively low temperature for sintering. The sintering temperature need only be high enough and the time interval long enough to produce a good bond between the powder particles of the two metals, but not enough to cause dimensional changes. Such temperatures and time intervals will vary depending on the particular metals used, and may be readily determined by one of ordinary skill in the art with a minimum of experimentation. Should the temperature be too high or the time too long, relief compact 22 and base compact 32 will begin to mix and the highly desirable sharp periphery separating relief compact 22 from base compact 32 will be destroyed. Moreover, by keeping the sintering temperature low, normal shrinkage of composite 34 due to sintering which would result in a poor fit in coining press 42 illustrated in FIG. 2F, is avoided.

Where relief compact 22 comprises gold and base compact 32 comprises silver, it will not be necessary to provide a special reducing atmosphere in sintering chamber 36. Thus, during the sintering step, where silver and gold are the two metals used, any clean atmosphere will suffice.

If, however, metals other than gold and silver are preferred, it may be necessary to perform the step of sintering in a reducing atmosphere to avoid formation of oxide films on the metal surfaces, and to ensure bonding of the metal particles.

The final step of the process is indicated in FIG. 2F. A striking die 46 is brought into physical contact with sintered composite 34' which has been inserted in bottom die 44 of coining press 42.

Coining die cavity 12'' is formed identically to cavity 12' and cavity 12 in order to accommodate the relief portion 22' of composite 34'. However, in addition to the desired image of cavity 12'', bottom die 44 also carries engraving for forming any obverse side design 50.

Striking die 46 carries engraving for forming reverse side design 48. Designs 48 and 50 are embossed upon base compact 32' when striking die 46 is brought into contact with composite 34'. This process may be repeated several times in order to get the desired height in relief for designs 48 and 50 on base compact 32' and to obtain the preferred proof finish of base compact 32'. Optimally, the striking die 46 will impinge on composite 34' at a total force of approximately 300 tons.

Because composite 34 will expand slightly upon extraction from collar 24 in FIG. 2D, the diameter of phantom inner cylinder 28' shown in FIG. 2F is approximately 0.010 inches larger than the diameter of phantom inner cylinder 28 of FIG. 2B.

The final product of the present invention is illustrated in FIG. 2G. There base compact 32' is shown embossed with obverse design 50 and reverse design 48.

In addition, the final product 52 may bear reeding along its side wall or periphery by forming the negative of the desired reeding along the inner wall 54 of coining press 42 as depicted in FIG. 2F.

The present invention may be embodied in other specific forms without departing from the spirit or essential attributes thereof and, accordingly, reference should be made to the appended claims, rather than to the foregoing specification as indicating the scope of the invention.

I claim:

1. A method of making a bi-metal object having a base and at least one area raised in relief on said base, said relief being formed of a first metal and said base being formed of a second metal with a sharp border between the two metals, the steps comprising:

a. providing a first die cavity which is the negative of the relief to be formed;

b. filling said first die cavity with a powder of said first metal;

c. compacting said first metal powder in said first die cavity to form a cohesive relief compact and removing any excess metal from the edges of said compact;

d. providing a phantom die area which is the negative of said base and having a second die cavity identical to said first die cavity, said second die cavity being positioned at the bottom of said phantom die area, and said relief compact being seated within said second die cavity;

e. filling the remainder of said second die cavity above said relief compact and partially filling said phantom die area with a powder of said second metal;

f. compacting said second metal powder to form a composite with said relief compact;

g. sintering said composite at a temperature and for a time sufficient to produce a durable bi-metal object, but insufficient to produce any significant dimensional change in said composite; and h. striking the final design of said base in a coining press, the bottom die of said press having a coining die cavity identical in configuration and position to said second die cavity.

2. A method according to claim 1 wherein said bi-metal object is a coin or medal.

3. A method according to claim 2 wherein said first metal is gold.

4. A method according to claim 2 wherein said second metal is silver.

5. A method according to claim 2 wherein said first metal is 24 karat gold, said second metal is fine silver, and the powders of each metal have average particle sizes in the range of about ½ to 15 microns diameter.

6. A method according to claim 5 wherein the sintering step is carried out at a temperature of about 400°F. for about 2 hours in a clean atmosphere.

7. A method according to claim 1 wherein prior to step (c) said first die cavity and said first metal powder are covered with a relatively resilient material, and said resilient material is pressed against said first metal powder during the compacting step (c).

8. A method according to claim 1 wherein compacting step (c) is carried out at a total pressure of less than 1 ton.

9. A method according to claim 1 wherein compacting step (f) is carried out at a pressure of about 20 to 60 tons per square inch.

10. A method according to claim 1 wherein compacting step (f) is carried out in a dual action press.

11. A method according to claim 2 wherein said phantom area is defined by a collar mounted on a first die, said first die comprising said first die cavity.

12. A method according to claim 11 wherein the inside diameter of said collar is slightly smaller than the final diameter of the bi-metal coin.

13. A method according to claim 1 wherein said relief compact is ejected from said first die cavity prior to step (d) and seated in said second die cavity.

14. A method according to claim 1 wherein said composite formed by step (f) is ejected from said second die cavity prior to sintering.

15. A bi-metal object formed by the method of claim 1.

16. A bi-metal coin or medal formed by the method of claim 6 and having a gold relief raised about 0.100 inches or more above the abutting base surface.

17. A bi-metal coin or medal according to claim 16 wherein said silver base has a proof finish.

* * * * *